US006304191B1

(12) United States Patent
Campbell et al.

(10) Patent No.: US 6,304,191 B1
(45) Date of Patent: Oct. 16, 2001

(54) UNI-DIRECTIONAL PROTOCOL

(75) Inventors: David E. Campbell, Mountain View, CA (US); Eric T. Kiser, Lesage, WV (US)

(73) Assignee: American Meter Co., Scott Depot, WV (US)

( * ) Notice: Subject to any disclaimer, the term of this patent is extended or adjusted under 35 U.S.C. 154(b) by 0 days.

(21) Appl. No.: 09/281,707

(22) Filed: Mar. 30, 1999

(51) Int. Cl.[7] ..... G08C 15/08

(52) U.S. Cl. ..... 340/870.14; 340/870.02; 375/130

(58) Field of Search ..... 340/870.02, 870.14, 340/870.16; 375/130, 140, 141, 146; 370/252, 310, 338, 349, 503

(56) References Cited

U.S. PATENT DOCUMENTS

| | | | | |
|---|---|---|---|---|
| 3,753,228 | | 8/1973 | Nickolas et al. | 340/146.1 |
| 3,777,066 | | 12/1973 | Nicholas | 179/69.5 R |
| 4,396,915 | * | 8/1983 | Farnsworth et al. | 340/870.02 |
| 4,799,059 | | 1/1989 | Grindahl et al. | 340/870.03 |
| 5,056,107 | | 10/1991 | Johnson et al. | 375/1 |
| 5,252,967 | | 10/1993 | Brennan et al. | 340/870.02 |
| 5,428,555 | | 6/1995 | Starkey et al. | 364/551.01 |
| 5,448,230 | | 9/1995 | Schanker et al. | 340/870.03 |
| 5,451,938 | | 9/1995 | Brennan, Jr. | 340/870.14 |
| 5,459,459 | | 10/1995 | Lee, Jr. | 340/870.02 |
| 5,469,150 | | 11/1995 | Sitte | 340/825.07 |
| 5,493,287 | | 2/1996 | Bane | 340/825.52 |
| 5,495,239 | | 2/1996 | Quellette | 340/870.02 |
| 5,519,387 | | 5/1996 | Besier et al. | 340/870.02 |
| 5,541,589 | | 7/1996 | Delaney | 340/870.02 |
| 5,553,094 | | 9/1996 | Johnson et al. | 375/200 |
| 6,100,817 | * | 8/2000 | Mason, Jr. et al. | 340/870.02 |

* cited by examiner

*Primary Examiner*—Timothy Edward, Jr.
(74) *Attorney, Agent, or Firm*—MacCord Mason, PLLC

(57) ABSTRACT

The present invention provides a unidirectional protocol for communicating data from a plurality of utility meters and a meter adapted to carry out this protocol. The meters are adapted to monitor and measure the respective utility parameters which may include those for gas, water, electric or other utilities, and wirelessly download the information to a meter reading device. The protocol basically includes a synchronization pattern followed by the desired information. For a valid transmission, the synchronization pattern and subsequent data are provided in a first transmission sequence, which is immediately repeated after the end of the first sequence. Preferably, a bit is toggled during the retransmission of the transmission sequence for security.

20 Claims, 5 Drawing Sheets

UNI-DIRECTIONAL PROTOCOL

BACKGROUND OF THE INVENTION

The present invention relates in general to meter reading, and, in particular, remotely reading groups of meters using a unidirectional communication system and protocol.

Utility companies are taking advantage of modem technology to reduce costs and increase efficiency in meter reading applications using wireless technology to remotely gather information from large groups of meters. Traditionally, utility meters, such as electric, water and natural gas, were manually read by utility workers visiting each meter location. Current technology allows meters to be remotely accessed from a central location through wire or wireless communication links. To further increase ease of reading and meter installation, these meters are battery powered and operate to gather parameter measurements for the respective types of meters, and various other information, and then communicate this information to a remotely situated meter reading device. Typically, large numbers of meters may be installed and configured to communicate wirelessly with a centralized remote meter reading device.

In order to keep maintenance low and operating efficiency high, it is desirable to have meters which can operate for an extended period of time without requiring maintenance, battery replacement and the like. Maintenance requirements are generally reduced by increasing battery capacity and reducing power consumption. As a result, the meters generally cycle between low-power sleep modes, to conserve energy, and full-power awake modes, when any combination of meter reading, information gathering, information processing and data transmission may occur. In order to further decrease meter cost and prolong battery life, these meters may be configured to only transmit data to the meter reading device since receiving data would result in a significant, additional toll on battery life.

In operation, the meters periodically awake from the sleep mode to gather information, such as meter parameter readings, and to check meter status. When the meter is awake, the parameter readings and meter status information may be wirelessly sent to the meter reading device and relayed on to a network or utility for processing the information.

In these applications, all of the meters located within range of the meter reading device must periodically transmit information to the meter reading device. As the number of meters increases, the likelihood of multiple meters transmitting information to the meter reading device at the same time increases. Furthermore, the frequencies at which these meters operate may likely be the same as other non-metering devices. The preferred bands are typically relatively narrow and made accessible to many different applications and technologies. Thus, there is a need for a low-cost meter and communication protocol capable of providing unidirectional communications to a remote meter reader while avoiding interference from other meters as well as other radio frequency transmissions within the communication range of the meter reading device.

SUMMARY OF THE INVENTION

The present invention provides a uni-directional protocol for communicating data from a plurality of utility meters and a meter adapted to carry out this protocol. The meters are adapted to monitor and measure the respective utility parameters which may include those for gas, water, electric or other utilities, and wirelessly download the information to a meter reading device. The protocol basically includes a synchronization pattern followed by the desired information. For a valid transmission, the synchronization pattern and subsequent data are provided in a first transmission sequence, which is immediately repeated after the end of the first sequence. Preferably, a bit is toggled during the retransmission of the transmission sequence for security.

The synchronization sequence at the beginning of each transmission sequence includes a series of 1's followed by six 0's and a final 1. The initial string of 1's identifies significant transitions of the modulation scheme while the following 0's and 1 signify the start of a new message. Preferably, the synchronization pattern is 1111111110000001. The second transmission sequence provides a robust checksum and, preferably, is an exact duplicate of the first transmission sequence with the exception of the bit toggled for security.

Each transmission sequence provides information about the meter identification indicia; version of the hardware, firmware or software; serial number; measured parameter values; and the type of utility meter being read. To reduce the risk of communication errors due to competing meters transmitting information to the remote meter reader, other RF communications and noise within the transmission field, the protocol is carried out at a non-standard baud rate, and the transmission sequences are randomly sent to minimize the risk of multiple meters awaking concurrently in a successive manner.

Transmissions are preferably on/off keyed wherein a carrier signal is turned on and off to indicate significant transitions. The period between transmissions represents the transmitted logic state. Using the carrier in this manner allows operation in a very narrow bandwidth and minimizes the risk of interference from devices using carriers in commonly used frequency bands.

Accordingly, one aspect of the present invention provides a protocol for a remote automatic meter reading system having a plurality of meters associated with communication electronics adapted to wirelessly transmit information to a remote meter reader for collection. The protocol includes: (A) providing a synchronization string including a synchronizing string for synchronizing a transmission signal and a start string for indicating the start of data being transmitted; (B) providing meter identification indicia for uniquely identifying a transmitting meter; (C) providing measurement indicia representing a parameter measured by the transmitting meter; (D) assembling a transmission sequence in a select order to provide the synchronization string followed by the meter identification indicia followed by the measurement indicia; (E) transmitting the transmission sequence; (F) modifying the transmission sequence for security; and (G) transmitting the modified transmission sequence immediately following the transmission of the transmission sequence.

The modifying step may include toggling a bit in the latter transmission sequence. Furthermore, the transmission sequence may also include software, hardware or firmware version indicia, serial numbers for the transmitting meter, meter type indicia as well as status information. Preferably, the synchronization string is 1111111110000001. The data transmitted after the synchronization string is preferably assembled and configured to not include or be arranged such that a string of 000000 occurs. Preferably, the data is transmitted by on/off keying a sinusoidal carrier frequency at a non-standard baud rate, such as 20 Kbits per second.

Typically, the keying indicates significant transition for data wherein the period between transitions indicates a logic 0 or 1. The preferred carrier is 433 MHz in Europe and 457 MHz in the United States, although any RF frequency will provide satisfactory operation. The referenced frequencies are within bands in the respective countries allocated for such use. The application is especially useful when narrow band-width communication limitations are desired or required.

Another aspect of the present invention provides a utility meter adapted to wirelessly communicate with a remote meter reader to collect meter information. The meter includes metering mechanics for measuring a utility parameter and has an output providing measurement indicia. A control system with associated memory receives the measurement indicia and assembles data into a transmission sequence. The meter also includes a transmitter and antenna associated with the control system to transmit the transmission sequence. In particular, the control system and a memory are configured to: (1) provide a synchronization string of nine 1's, six 0's and a 1 (1111111110000001) for synchronizing a transmission signal and indicating a start of data being transmitted; (2) provide meter identification indicia for uniquely identifying a transmitting meter; (3) provide version indicia representing a hardware/software version of the transmitting meter; (4) provide a serial number for the transmitting meter; (5) provide measurement indicia representing a parameter measured by the transmitting meter; (6) provide meter type indicia; (7) provide division indicia correlating the measurement indicia with the parameter; (8) provide meter status indicia; (9) assemble a transmission sequence in a select order to provide the synchronization string followed by the meter identification indicia, followed by the version indicia, followed by the serial number, followed by the measurement indicia, followed by the meter type indicia, followed by the division indicia, followed by the status indicia; (10) transmit the first transmission sequence via the transmitter; (11) modify the first transmission sequence for security to provide a second transmission sequence; and (12) transmit the modified second transmission sequence immediately following the transmission of the first transmission sequence via the transmitter.

These and other aspects of the present invention will become apparent to those skilled in the art after reading the following description of the preferred embodiments when considered with the drawings.

DETAILED DESCRIPTION OF THE PREFERRED EMBODIMENTS

It will be understood that the illustrations are for the purpose of describing a preferred embodiment of the invention and are not intended to limit the invention thereto.

Figure 1:
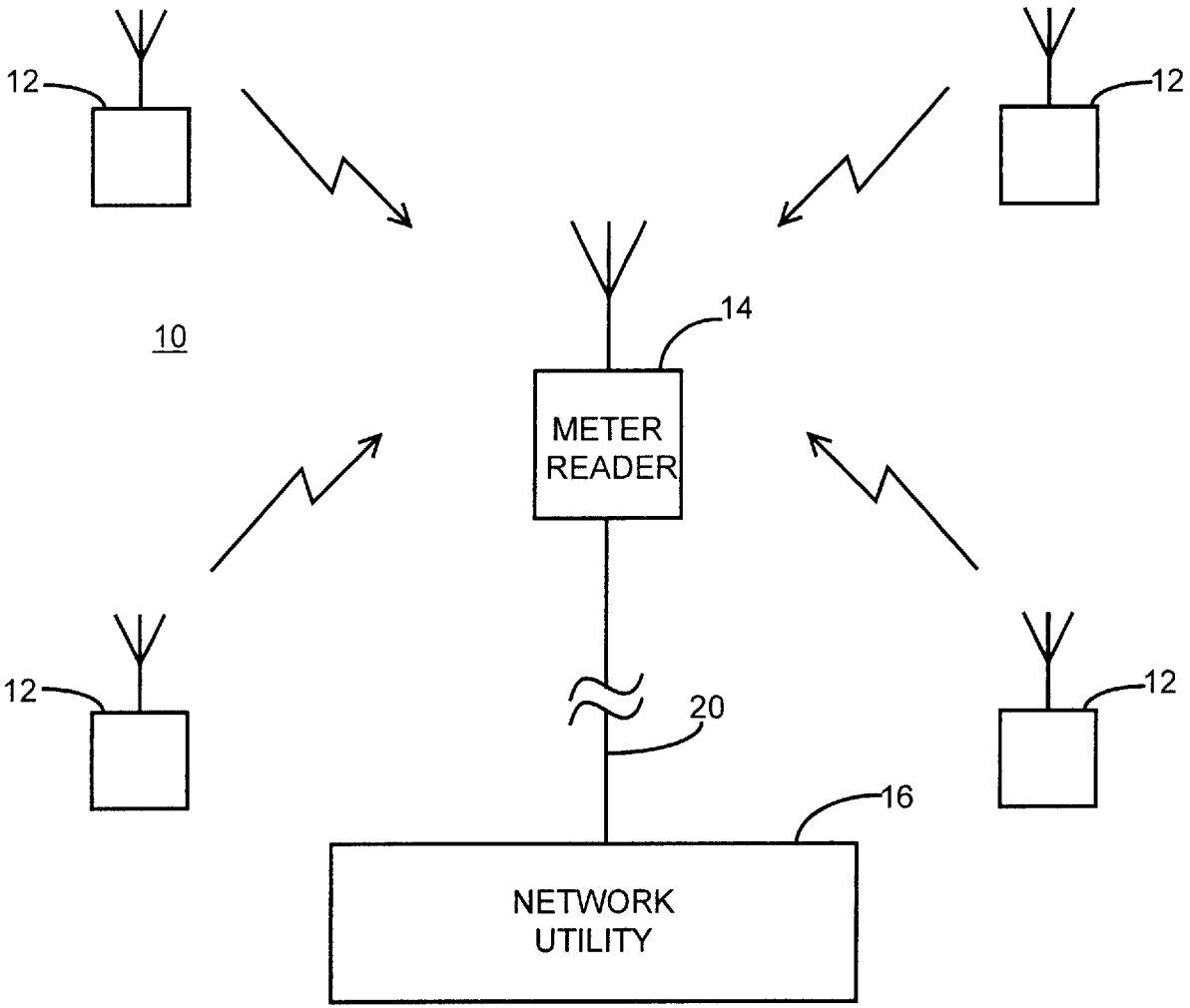
FIG. 1 is a schematic representation of a remote meter reading system constructed according to the present invention.

With reference to the drawing figures, and FIG. 1 in particular, a remote meter reading system 10 is shown in accordance with the present invention. This system includes multiple utility meters 12 and a remote meter reading device, hereinafter meter reader 14, which is further coupled to a remote network or utility company computer system 16 via wire or wireless means. Preferably, the network connection is made using a telephone line 20. The meter reader 14 is located within communication range of the utility meters 12.

Figure 2:
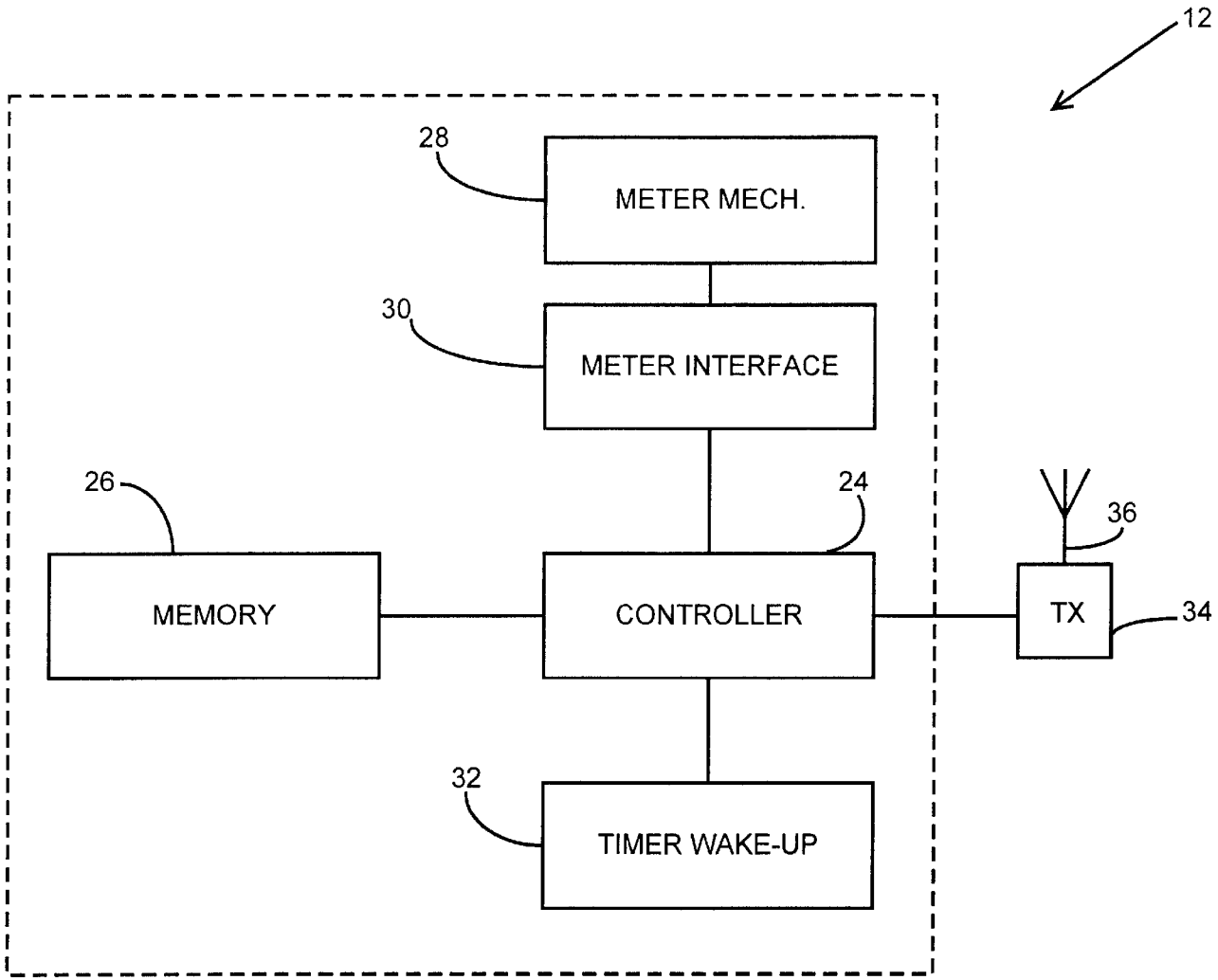
FIG. 2 is a block diagram of a utility meter constructed according to the present invention.

With reference to FIG. 2, a block diagram of a utility meter 12 is shown constructed according to the present invention. The meter 12 will include a control system having a controller 24 and memory 26. The controller 24 is adapted to gather data from metering mechanics 28 through a meter interface 30. The metering mechanics will provide utility measurement parameters based on usage for any number of utilities, such as electric, water, gas and other similar utilities.

The controller 24 will operate in conjunction with a timer or wake-up circuitry 32 to facilitate power consumption management, and preferably cycle between a low-power sleep mode and an active mode to measure parameters accumulating at the meter mechanics 28. The meter is also adapted to communicate to the remote meter reader 14 through communication electronics having a transmitter 34 and associated antenna 36. The controller 24 and transmitter 34 cooperate to transmit communication signals over a communication channel, such as an RF channel, using well-known principles. The controller 24 operates using logic and software associated with the controller 24 and memory 26. When signals are transmitted from the meter 12, a transmission sequence assembled by the controller 24 is processed by the transmitter 34 and radiated through the antenna 36.

The memory 26 has storage capabilities and can store information and parameters received from the metering mechanics 28 through the meter interface 30, along with various other types of information, such as identification indicia, software and hardware version numbers, serial numbers, utility meter type, pre-divider information and meter status information. The pre-divider information is representative of the multiple or divisor associated with the metering mechanics 28 to arrive at an accurate quantity or total parameter measurement. For example, the metering mechanics 28 of a natural gas flow meter may turn one hundred times for each cubic unit of gas passing through the meter. In this embodiment, the pre-divider would be a divisor of 100. The controller 24 in association with the memory 26 will assemble a transmission sequence from this information.

Figure 3:
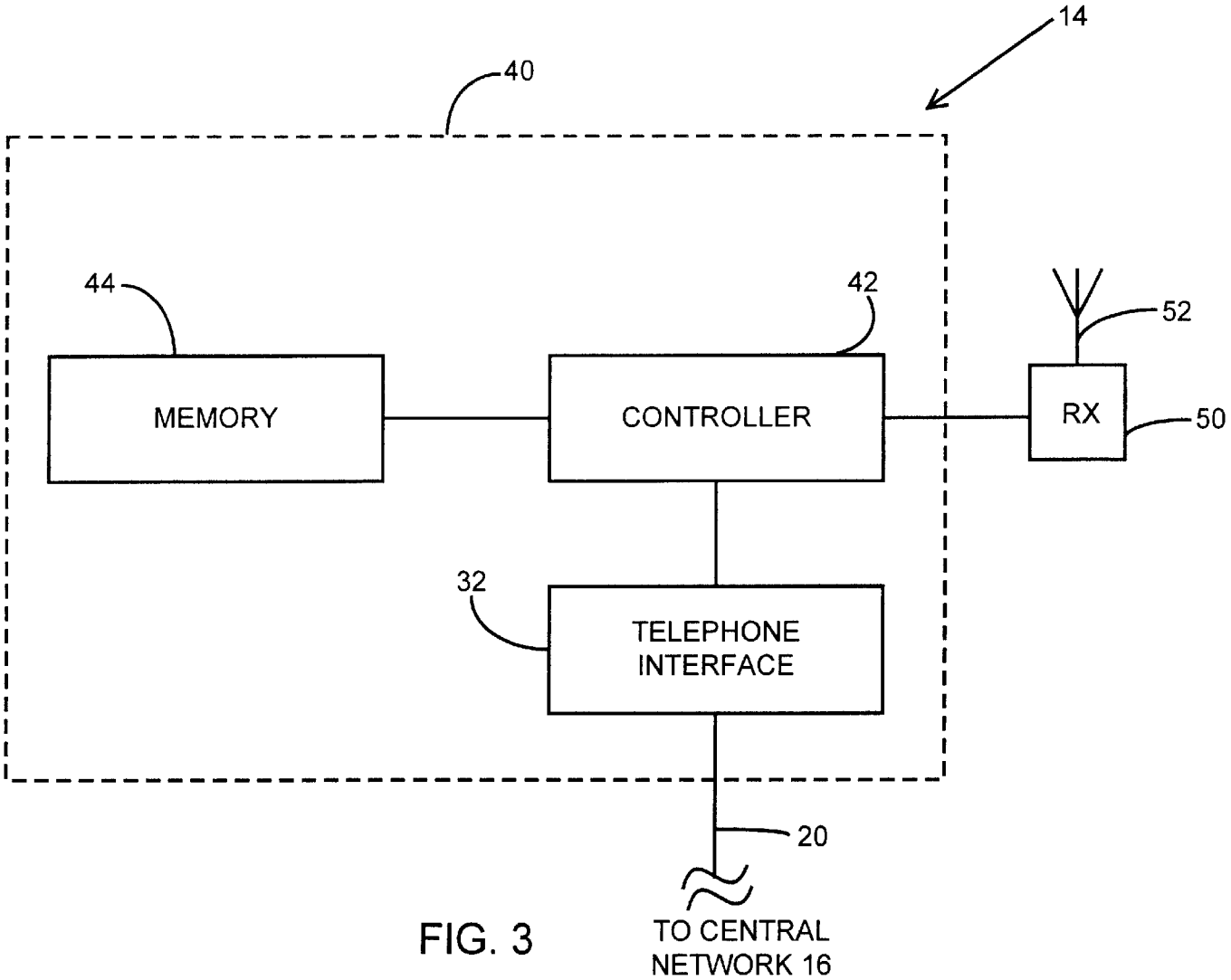
FIG. 3 is a block diagram of a meter reading device constructed according to the present invention.

A schematic of the remote meter reader 14 is shown in FIG. 3. The meter reader 14 includes a control system 40 having a controller 42, memory 44 and a telephone or other communication interface 46. The memory 44 preferably provides the necessary operating software for the controller 42 and provides storage capability for the information received from the various utility meters 12. The telephone interface 46, or like communication electronics, allows connection to the central network 16 or utility company in order to forward for further processing the information collected from the various utility meters. The meter reading device also includes a receiver 50 and antenna 52 cooperating with the controller 42 to receive transmission sequences from the various utility meters 12.

In operation, the various utility meters 12 will periodically, and preferably randomly, wake up and transmit data to the remote meter reading device 14. While the meter electronics are "awake," the control system will read parameters from the metering mechanics 28, update the memory 26, assemble a transmission sequence and transmit the information according to the protocol discussed below to the remote meter reading device 14.

Figure 4:
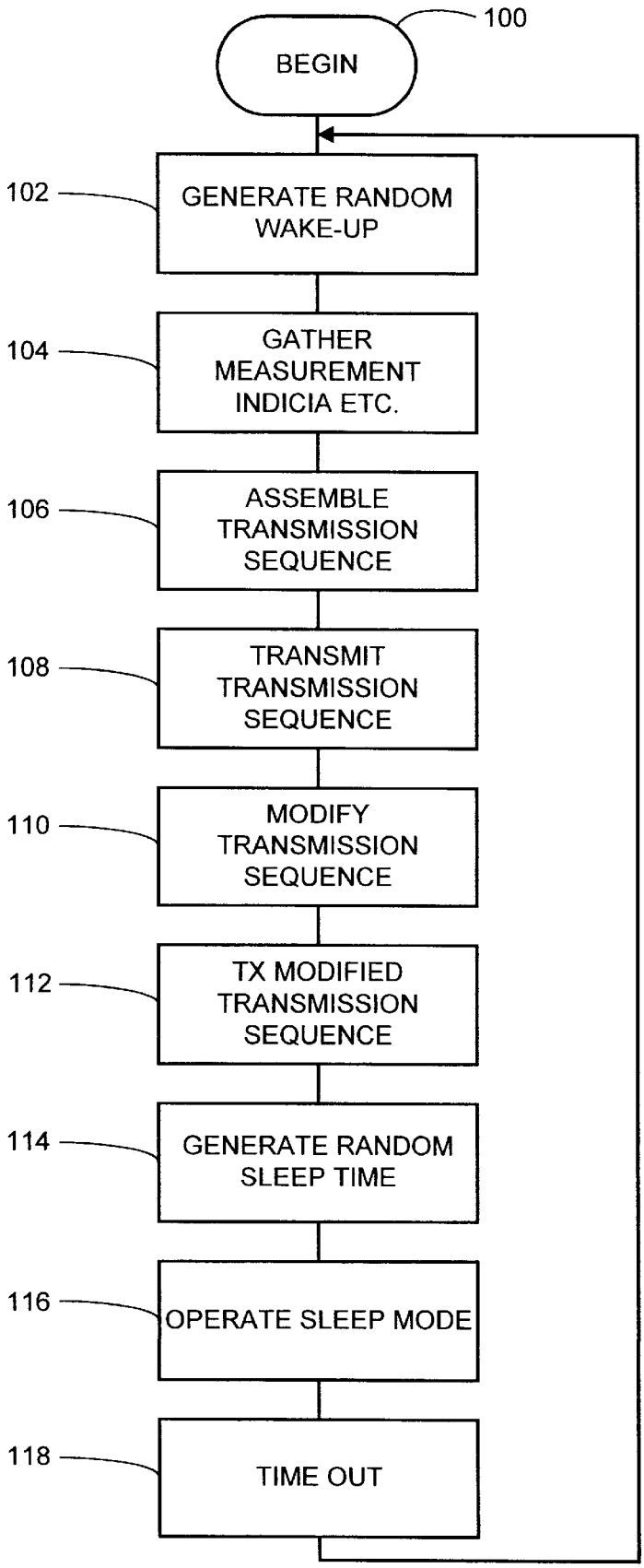
FIG. 4 is a flowchart representing the basic operation of a meter constructed according to the present invention.

With reference to FIG. 4, a flow chart of the basic operation of each utility meter 12 is shown. The process begins (block 100) wherein the utility meter 12 is in a low-power sleep mode. The timer or wake-up circuitry 32 will subsequently generate a random wake-up signal (block 102) in order to activate the control system. Parameter or measurement indicia is gathered from the meter mechanics 28 and/or any electronic counting circuitry associated with the metering mechanics (block 104). The control system may also check memory 26 or other logic circuitry to determine identification indicia, hardware and software versions, serial numbers, utility meter type, pre-dividers and status information. The control system will next assemble a transmission sequence (block 106) according to the protocol of the present invention. The control system will operate in conjunction with the transmitter 34 to transmit the transmission sequence (block 108), modify the transmission sequence (block 110), and transmit the modified transmission sequence immediately after transmitting the first transmission sequence (block 112).

Preferably, the control system 40 will generate a random sleep time to set the timer or wake-up circuitry 32 (block 114) and power down into a "sleep" mode (block 116). With the exception of any counter circuitry associated with the meter mechanics 28, most, if not all, of the control system's electronics will operate in the low-power sleep mode until the timer 32 times out (block 118), wherein the process begins anew (block 100).

Figure 5:
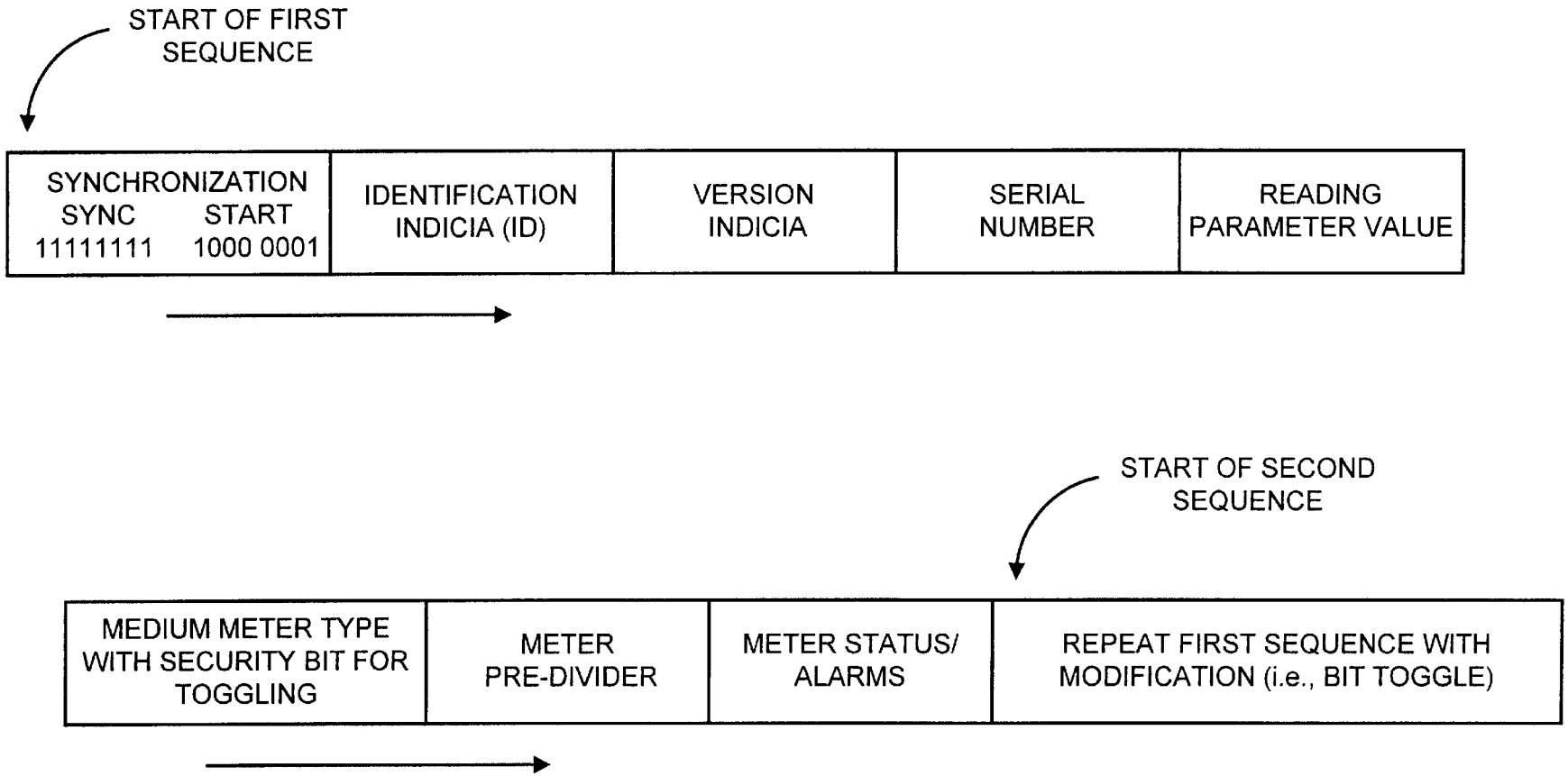
FIG. 5 represents the preferred protocol sequence for communicating information from a utility meter to a remote reading device according to the present invention.

The preferred embodiment of the protocol is shown in FIG. 5 wherein consecutive sequences of data are transmitted from the transmitting utility meter 12. Each sequence preferably includes a synchronization string including a series of eight 1's for identifying significant transitions of the modulation scheme and a "10000001" string signifying the start of a new message. Preferably, none of the data assembled in either of the sequences will ever include six 0's in sequence in order to allow the remote meter reader 14 to clearly identify the start of a sequence and avoid any possible confusion with, the data falsely indicating the start of a new sequence. The synchronization sequence is followed, in order, by identification indicia, version indicia, the meter's serial number, a parameter value reading, the meter type, the meter pre-divider and the meter status or alarm indicia. A second sequence is immediately transmitted following the first sequence. The second sequence is preferably an exact duplicate of the first sequence, including the synchronization strings, with the possible exception of a slight security modification. This modification is preferably toggling a bit in the meter type string.

Toggling a bit in the sequence allows the remote meter reader 14 to ensure that sequences are not sent repeatedly without change. Toggling this bit provides additional security as well as alerts the remote meter reader that a problem exists with one of the utility meters 12 if sequences from a meter are repeatedly sent without change. Toggling a bit for security in addition to duplicating the first sequence provides a "super checksum."

In the preferred embodiment, the respective transmitter and receiver for the utility meters and remote meter reader 14 are configured to transmit and receive an on-off keyed sinusoidal carrier. Preferably, transmission is made at a non-standard baud rate to further reduce the possibility of other devices interfering with the transmissions.

In the preferred embodiment, the utility meter is designed to transmit a message, on average, approximately twelve times in a 24-hour period. The time between transmissions will vary from one hour to four hours, and will vary due to differences in timer settings and a pseudo-random algorithm adapted to generate the settings controlling the time between transmissions. Preferably, in order to keep the various meters from independently synchronizing, a serial number is used as a seed value in the pseudo-random 1.

The remote meter reader 14 and its control system 40 continuously monitor for a string of 1's. Once four or more consecutive 1's are detected, the board monitors for a "10000001" pattern. If any illegal bits are received, or if a string other than six consecutive 0's occurs, the meter will again look for the consecutive 1's for synchronization. The board uses the initial string of 1's followed by the six consecutive 0's to synchronize the message, or data following the synchronization string. The message will be referred to hereinafter as a sub-telegram for clarity.

Once the sub-telegram has been received, a string of consecutive 1's from the second transmission sequence must be received. If fewer than four or more than twenty consecutive 1's occur immediately following the first transmission sequence or if any illegal bits occur, the meter reader will abort the communication and again monitor for a synchronization string for a first sequence.

As noted, the second sequence must immediately follow the first transmission sequence wherein the string of consecutive 1's must be followed immediately by the "1000001" pattern of the synchronization string. If anything else is received, the transmission is again aborted. Assuming the synchronization pattern is successfully received during the second sequence immediately following the first sequence, the second sub-telegram must match the first sub-telegram exactly, with the exception of the security bit being toggled. If the second transmission sequence does not match the first sub-telegram in this manner, the communication is aborted and the meter reader will again monitor for the synchronization pattern of a first transmission sequence from the same or other utility meter. If the second transmission sequence immediately follows the first, and the second sub-telegram therein matches the first sub-telegram of the first transmission sequence as described, the message is received as valid and processed accordingly.

If a meter stops responding for more than a 24-hour period, the meter reader may communicate to a remote network or utility 16 that a failure has occurred for a particular utility meter. Similarly, if more than a predetermined number of consecutive messages are received from a given transponder in which the security bit of the "medium" string does not change, then a communications failure will be reported for that meter.

Assuming a transmission is valid, the meter reader 14 will operate on the various data received from the various utility meters 12 or simply send the sub-telegrams including all of the information, with the exception of the synchronization string, to the remote network or utility 16 for data concentration and processing. Preferably, the meter reader 14 and the remote network or utility 16 will bi-directionally communicate at 9600 baud over a telephone line communication link. In contrast, the RF link between the utility meters 12 and the meter reader 14 is preferably unidirectional and will communicate at a non-standard baud rate, such as 20 Kbits per second. Using the nonstandard baud rate for the RF modulation signal reduces the likelihood of undesired signals being detected as valid bits during communication.

Furthermore, since communications are only carried out in one direction, the various utility meters may periodically communicate simultaneously. If the communications interfere with one another to an extent that the meter reader 14 cannot accurately receive the transmissions, the transmission for that wake-up interval will simply be missed, and the data will be retransmitted at the later pseudo-randomly determined communication time. The number of utility meters 12 and the frequency of communication attempts should be configured so that during any 24-hour period, a predetermined number of successive communications are probable from each meter.

Certain modifications and improvements will occur to those skilled in the art upon reading the foregoing description. It should be understood that all such modifications and improvements have been deleted herein for the sake of conciseness and readability, but are properly within the scope of the following claims.

What is claimed is:

1. A protocol for a remote automatic meter reading system having a plurality of meters associated with communication electronics adapted to wirelessly communicate with a remote meter reader to collect meter information, the protocol comprising:

a. providing a synchronization string including a synchronizing string for synchronizing a transmission signal and a start string for indicating a start of data being transmitted;

b. providing meter identification indicia for uniquely identifying a transmitting meter;

c. providing measurement indicia representing a parameter measured by the transmitting meter;

d. assembling a transmission sequence in a select order to provide the synchronization string followed by the meter identification indicia followed by the measurement indicia;

e. transmitting the transmission sequence;

f. modifying the transmission sequence for security; and g. transmitting the modified transmission sequence immediately following the transmission of the transmission sequence.

2. The protocol of claim 1 further including the steps of:

a. providing version indicia representing a hardware of software version of the transmitting meter; and b. providing a serial number for the transmitting meter, the assembling step assembling the transmission sequence to provide the synchronization string followed by the meter identification indicia followed by the version indicia followed by the serial number followed by the measurement indicia.

3. The protocol of claim 1 further comprising the step of providing meter type indicia, the assembling step assembling the transmission sequence to provide the synchronization string followed by the meter identification indicia followed by the measurement indicia followed by the meter type indicia.

4. The protocol of claim 1 further including the steps of:

a. providing version indicia representing a hardware or software version of the transmitting meter;

b. providing a serial number for the transmitting meter; and c. providing meter type indicia, the assembling step assembling the transmission sequence to provide the synchronization string followed by the meter identification indicia followed by the version indicia followed by the serial number followed by the measurement indicia followed by the meter type indicia.

5. The protocol of claim 1 wherein the transmission steps include on/off keying the data transmission sequences at a single frequency.

6. The protocol of claim 1 wherein the transmission steps include turning a carrier frequency on or off to provide a significant transition and providing a first interval between transitions for a first logic level and a second interval between transitions for a second logic level.

7. The protocol of claim 1 wherein the transmission steps include randomly transmitting the consecutive transmission sequences to substantially avoid simultaneous communications with other meters.

8. The protocol of claim 1 wherein the synchronizing string is 1111111110000001 and data transmitted in the transmission sequence does not include a string of 000000.

9. The protocol of claim 1 wherein the modifying step includes toggling a bit in the latter transmission sequence.

10. The protocol of claim 9 wherein the transmission sequence differs from the modified transmission sequence by only one bit.

11. The protocol of claim 1 further including the steps of:

a. providing version indicia representing a hardware or software version of the transmitting meter;

b. providing a serial number for the transmitting meter; and c. providing meter type indicia;

the assembling step assembling the transmission sequence to provide the synchronization string followed by the meter identification indicia followed by the version indicia followed by the serial number followed by the measurement indicia followed by the meter type indicia, the modifying step consisting of toggling a bit in the transmission sequence.

12. The protocol of claim 7 wherein the transmission sequence differs from the modified transmission sequence by only one bit.

13. The protocol of claim 12 wherein the transmission sequence differs from the modified transmission sequence by only one bit in the meter type indicia.

14. A protocol for a remote automatic meter reading system having a plurality of meters associated with communication electronics adapted to wirelessly communicate with a remote meter reader to collect meter information, the protocol comprising:

a. providing a synchronization string of 1111111110000001 for synchronizing a transmission signal and indicating a start of data being transmitted;

b. providing meter identification indicia for uniquely identifying a transmitting meter;

c. providing version indicia representing a hardware or software version of the transmitting meter;

d. providing a serial number for the transmitting meter;

e. providing measurement indicia representing a parameter measured by the transmitting meter;

f. providing meter type indicia;

g. providing division indicia correlating the measurement indicia with the parameter;

h. providing meter status indicia;

i. assembling a transmission sequence in a select order to provide the synchronization string followed by the meter identification indicia followed by the version indicia followed by the serial number followed by the measurement indicia followed by the meter type indicia followed by the division indicia followed by the status indicia;

j. transmitting the transmission sequence;

k. modifying the transmission sequence for security by toggling a bit in the meter type indicia; and l. transmitting the modified transmission sequence immediately following the transmission of the transmission sequence.

15. A utility meter adapted to wirelessly communicate with a remote meter reader to collect meter information comprising:

a. a meter for measuring a utility parameter and having an output providing measurement indicia;

b. a control system and memory associated with said meter to receive measurement indicia and assemble data into a transmission sequence; and c. a transmitter associated with said control system adapted to transmit the transmission sequence;

d. said control system and memory adapted to:

i. provide a synchronization string including a synchronizing string for synchronizing a transmission signal and a start string for indicating a start of data being transmitted;

ii. provide meter identification indicia for uniquely identifying a transmitting meter;

iii. provide measurement indicia representing a parameter measured by the transmitting meter;

iv. assemble a first transmission sequence in a select order to provide the synchronization string followed by the meter identification indicia followed by the measurement indicia;

v. transmit the first transmission sequence via said transmitter;

vi. modify the first transmission sequence for security to provide a second transmission sequence; and vii. transmit the modified second transmission sequence immediately following the transmission of the first transmission sequence via said transmitter.

16. The utility meter of claim 15 firther wherein said control system and memory are further adapted to:

a. provide version indicia representing a hardware or software version of the transmitting meter;

b. provide a serial number for the transmitting meter;

c. provide meter type indicia; and d. assemble the first transmission sequence to provide the synchronization string followed by the meter identification indicia followed by the version indicia followed by the serial number followed by the measurement indicia followed by the meter type indicia, the modifying step consisting of toggling a bit in the transmission sequence.

17. The utility meter of claim 15 wherein the synchronizing string is 1111111110000001 and data transmitted in the transmission sequence does not include a string of 000000.

18. The utility meter of claim 15 wherein said transmitter and said control system provide on/off keying the data transmission sequences at a single carrier frequency.

19. The utility meter of claim 15 wherein said transmitter and said control system turn a carrier frequency on or off to provide a significant transition and provide a first interval between transitions for a first logic level and a second interval between transitions for a second logic level.

20. A utility meter adapted to wirelessly communicate with a remote meter reader to collect meter information comprising:

a. a meter for measuring a utility parameter and has an output providing measurement indicia;

b. a control system and memory associated with said meter to receive measurement indicia and assemble data into a transmission sequence; and c. a transmitter associated with said control system adapted to transmit the transmission sequence;

d. said control system and memory adapted to:

i. provide a synchronization string of 1111111110000001 for synchronizing a transmission signal and indicating a start of data being transmitted;

ii. provide meter identification indicia for uniquely identifying a transmitting meter;

iii. provide version indicia representing a hardware or software version of the transmitting meter;

iv. provide a serial number for the transmitting meter;

v. provide measurement indicia representing a parameter measured by the transmitting meter;

vi. provide meter type indicia;

vii. provide division indicia correlating the measurement indicia with the parameter;

viii. provide meter status indicia;

ix. assemble a transmission sequence in a select order to provide the synchronization string followed by the meter identification indicia followed by the version indicia followed by the serial number followed by the measurement indicia followed by the meter type indicia followed by the division indicia followed by the status indicia;

x. transmit the first transmission sequence via said transmitter;

xi. modify the first transmission sequence for security to provide a second transmission sequence; and xii. transmit the modified second transmission sequence immediately following the transmission of the first transmission sequence via said transmitter, wherein data transmitted in the transmission sequences does not include a string of 000000.

* * * * *